US008051780B2

(12) United States Patent
Bodescot et al.

(10) Patent No.: US 8,051,780 B2
(45) Date of Patent: Nov. 8, 2011

(54) TRAIN DRIVER'S CAB COMPRISING A CANOPY

(75) Inventors: Christophe Bodescot, Saint Jean de Liversay (FR); Eric Courcimeaux, Dompierre sur Mer (FR)

(73) Assignee: Alstom Transport SA, Levallois-Perret (FR)

( * ) Notice: Subject to any disclaimer, the term of this patent is extended or adjusted under 35 U.S.C. 154(b) by 36 days.

(21) Appl. No.: 12/156,765

(22) Filed: Jun. 4, 2008

(65) Prior Publication Data

US 2008/0309125 A1 Dec. 18, 2008

(30) Foreign Application Priority Data

Jun. 7, 2007 (FR) ..... 07 55569

(51) Int. Cl.
*B61C 17/04* (2006.01)

(52) U.S. Cl. ..... 105/456

(58) Field of Classification Search ..... 105/456; 114/71, 76; 244/122 AE, 122 AF; 296/100.17, 296/190.08, 193.12, 146.15, 215
See application file for complete search history.

(56) References Cited

U.S. PATENT DOCUMENTS

| | | | | |
|---|---|---|---|---|
| 3,259,345 | A * | 7/1966 | Martignoni et al. | 244/129.3 |
| 7,077,459 | B2 * | 7/2006 | Toth et al. | 296/178 |
| 2007/0216159 | A1 * | 9/2007 | Yoshihara et al. | 285/288.1 |

FOREIGN PATENT DOCUMENTS

| | | |
|---|---|---|
| DE | 43 43 800 | 6/1995 |
| EP | 0 533 582 | 1/1995 |
| GB | 532388 | 6/1939 |
| GB | 2 259 539 | 3/1993 |
| JP | 2000177383 | 6/2000 |

OTHER PUBLICATIONS

Starlinger et al. "Die Frontkabine der neuen AEG-Hochleistungslokomotive 12X in GFK-Sandichbauweise", Zeitschrift fur Eisenbahnwesen and Verkehrstechnik—Glasers Annalen 119 Sep. / Oct. 1995, Nos. 9/10, Berlin, DE; XP000542119; ISSN: 0941-0589; p. 493-p. 496.

* cited by examiner

*Primary Examiner* — Joe Morano, IV
*Assistant Examiner* — Zachary Kuhfuss
(74) *Attorney, Agent, or Firm* — Davidson, Davidson & Kappel, LLC

(57) ABSTRACT

A cab of this type comprises a frame (3) defining an internal volume (3*a*), the frame (3) having at least one upper opening (3*b*) for receiving panes of glass of said cab, said cab being wherein it comprises a canopy (2) forming an assembly in a single piece which is attached to the frame (3) so as to cover the upper opening (3*b*) and enclose the internal volume (3*a*), said canopy comprising a support frame (10) provided with side rails (11) defining at least two openings therebetween and at least two panes of glass (4, 5, 6) filling each opening respectively.

12 Claims, 3 Drawing Sheets

TRAIN DRIVER'S CAB COMPRISING A CANOPY

This application claims priority French application FR 07 55569, filed on Jun. 7, 2007, the entire disclosure of which is incorporated by reference herein.

TECHNICAL FIELD

The present invention relates to a driver's cab of a train or the like, of the type comprising a framework defining an internal volume, the framework having an upper opening for receiving the glazing of said cab.

BACKGROUND TO THE INVENTION

In known train cabs of this type, the panes of glass, such as the windshield and the side bays, are mounted on the framework in succession and independently of one another. The cab is then equipped so as to have the desired aerodynamics and appearance, and a treatment is carried out around the glazing using an adhesive material to provide water- and air-tightness, since trains travelling at high speeds in tunnels are subjected to pressure waves.

The large panes of glass are stuck to the framework. The mechanical attachment of large glass elements is complex. The panes of glass have a complex shape and substantial thickness to match the shape of the cab and to be aerodynamically and aesthetically pleasing. Due to the geometric tolerances of the edges of the panes of glass and the corresponding supporting surfaces of the framework, it is difficult to fix such panes of glass to the framework by mechanical attaching means.

SUMMARY OF THE INVENTION

An object of the invention is to propose a set of panes of glass, which can easily be mounted onto the cab and reduces the operations required for the construction of the cab.

The invention accordingly relates to a train driver's cab of the above-mentioned type, wherein it comprises a canopy forming an assembly in a single piece which is attached to the framework so as to cover the upper opening and enclose the internal volume, said canopy comprising a canopy frame provided with side rails defining at least two openings therebetween and at least two panes of glass covering each opening respectively.

Since the canopy forms an assembly which is mounted in one piece on a train cab, the canopy can and the cab framework can be mounted apart from one another, making the mounting of the cab easier.

Furthermore, equipment can be mounted onto the cab prior to attachment of the canopy by passing said equipment through the wide opening for receiving the canopy, thereby further simplifying the mounting.

The cab and the canopy may be further equipped with an inner lining, equipment and electrical cables, for example, prior to the assembly of the canopy on the framework.

If necessary, it is possible to change the panes of glass one by one without having to disassemble the whole canopy, since they are attached by means of a detachable frame which is part of the canopy. Replacement of the panes of glass is therefore quick and effective, and the train is more readily serviceable than trains with stuck panes which require a significant drying time before the train is available again.

According to other embodiments, the canopy has one or more of the following features, considered individually or in any technically feasible combinations:

the canopy comprises all the fixed panes of glass of the cab;

the canopy comprises all the panes of glass of the cab;

the canopy frame comprises a skin made of an impermeable composite material;

the periphery of each pane of glass is attached to the side rails of the support frame by mechanical attaching means;

each pane of glass is surrounded by a metal frame forming the periphery of said pane, said frame being attached to the side rails by mechanical attaching means;

a metal sole piece is attached to the side rails of the support frame, the periphery of each pane of glass being attached to said sole piece by mechanical attaching means;

the composite lining material comprises polyester;

the canopy is in the form of a dome; and sealing means are disposed between the periphery of each glazing and the support frame.

BRIEF DESCRIPTION OF THE DRAWINGS

Other aspects and advantages of the invention will emerge from the following description which is given by way of example and refers to the accompanying drawings, in which.

DESCRIPTION OF PREFERRED EMBODIMENTS

Figure 1:
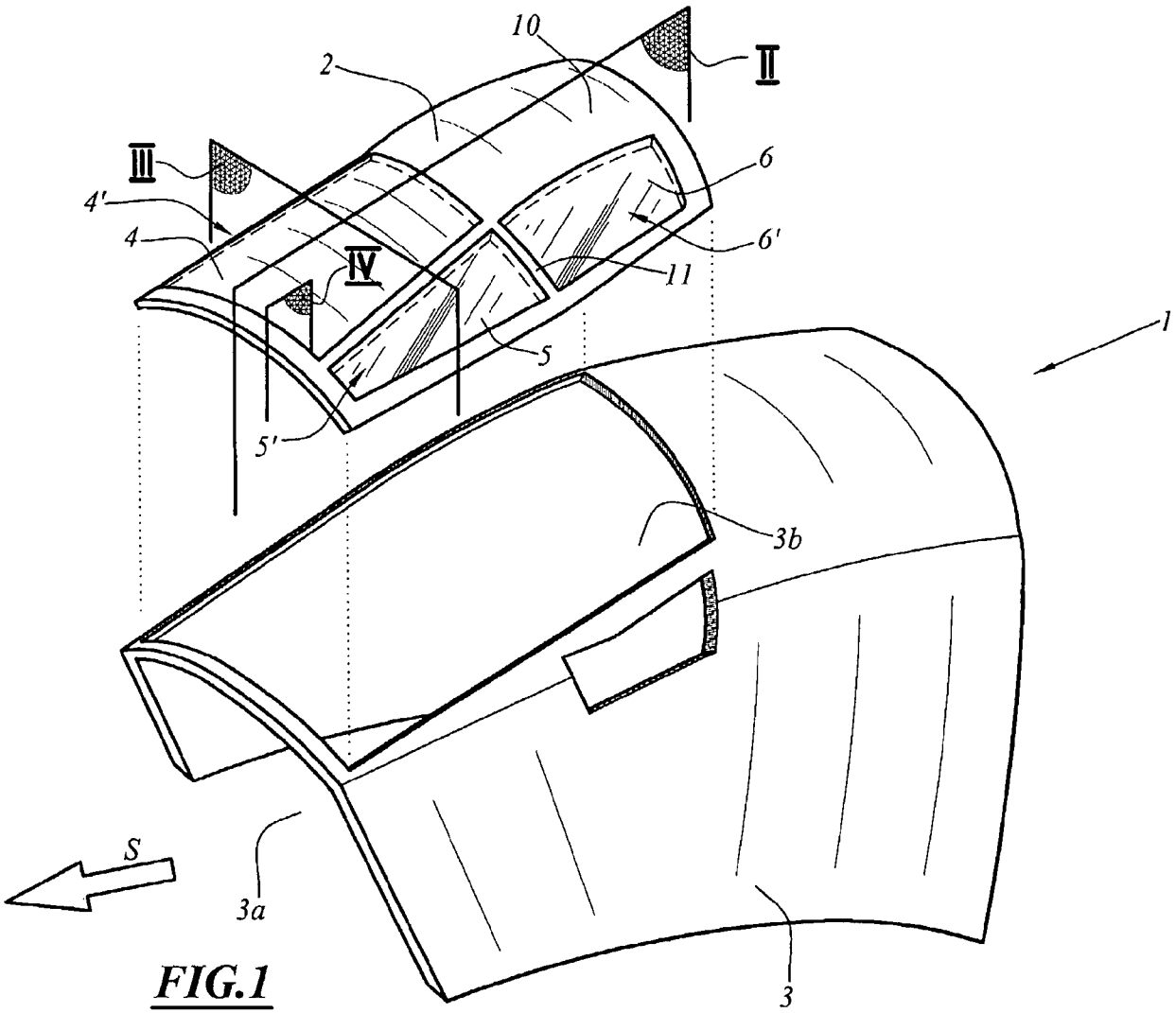
FIG. 1 is a partial perspective view of a train driver's cab according to the invention, the canopy being separate from said cab.

FIG. 1 shows a part of a driver's cab 1 of a train, in particular a high-speed train, comprising a canopy intended to be attached to a framework 3 of the cab 1. The framework 3 and the canopy 2 may therefore be made apart from one another.

In the description which follows, the words "front", "rear", "left", "right", "longitudinal", "transverse", "upper" and "lower" are understood to refer to the direction of travel of the vehicle in forward motion shown by the arrows in FIG. 1.

The framework 3 defines an internal volume 3*a* in which equipment may be mounted prior to attachment of the canopy 2 to the framework. The framework 3 comprises an upper opening 3*b* which is covered by the canopy 2 when said canopy 2 is attached so as to enclose the internal volume 3*a*. Mounting of the driver's cab is therefore simple. The canopy is attached to the framework 3 by attaching means (not shown) extending, for example, at the periphery of the canopy 2 and at the periphery of the opening 3*b*.

The canopy 2 comprises the set of panes of glass 4, 5, 6 which are required to give the train driver good visibility. According to the embodiment shown in the figures, the canopy comprises a windshield 4 disposed in the centre of the canopy 2, two front side apertures 5 disposed to the right and left of the windshield 4 respectively, and two rear side apertures 6, disposed adjacent to and to the rear of the front side apertures 5, as shown in FIG. 1.

According to one embodiment, the canopy comprises all the fixed panes of glass of the driver's cab. The word "fixed" refers to panes of glass which are "not openable", in other words, panes of glass which are permanently attached to the cab. In this embodiment, the openable panes of glass, in other words windows, which allow communication between the inside of the cab and the outside of the train, are provided on the framework of the driver's cab to allow the train-driver to communicate with staff on the platform, for example.

According to one embodiment, the canopy comprises all the panes of glass of the cab and no pane of glass is provided on the framework of the driver's cab.

The panes of glass 4, 5, 6 have a substantial thickness, for example of between 25 mm and 40 mm, are large (the windshield is between 1.3 m and 1.6 m long and between 1.2 m and 1.6 m wide, for example) and have a complex three-dimensional shape (variable thickness, profiled cut-out and non-planar surface, concave surface of the panes of glass, for example). The weight of the panes of glass is also substantial (the windshield weighs approximately 150 kg, for example). These panes of glass 4, 5, 6 are known and are used in particular in high-speed trains.

Figure 2:
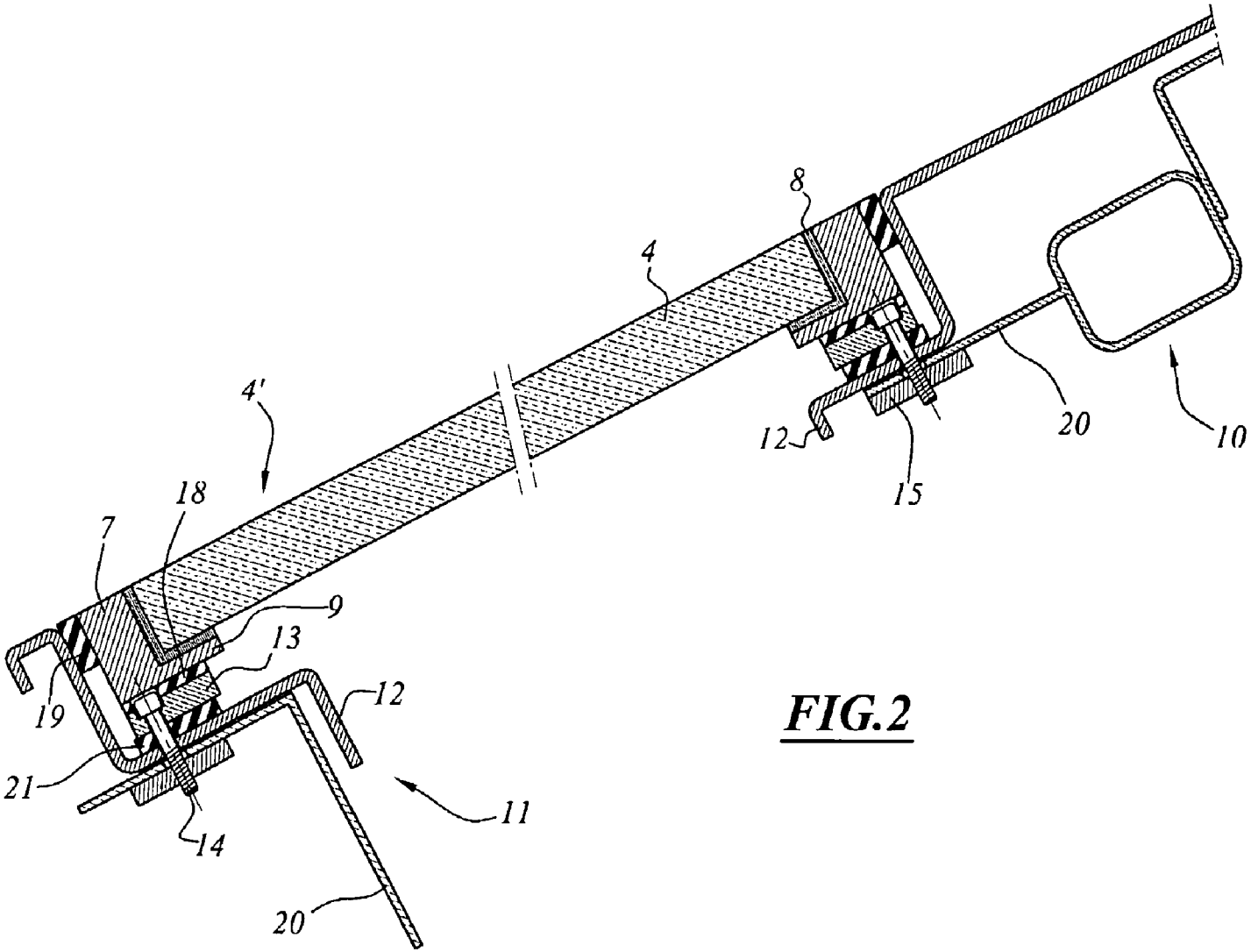
FIG. 2 is a cross-section of the canopy along the axis II-II in FIG. 1, the canopy being mounted on the framework.
Figure 3:
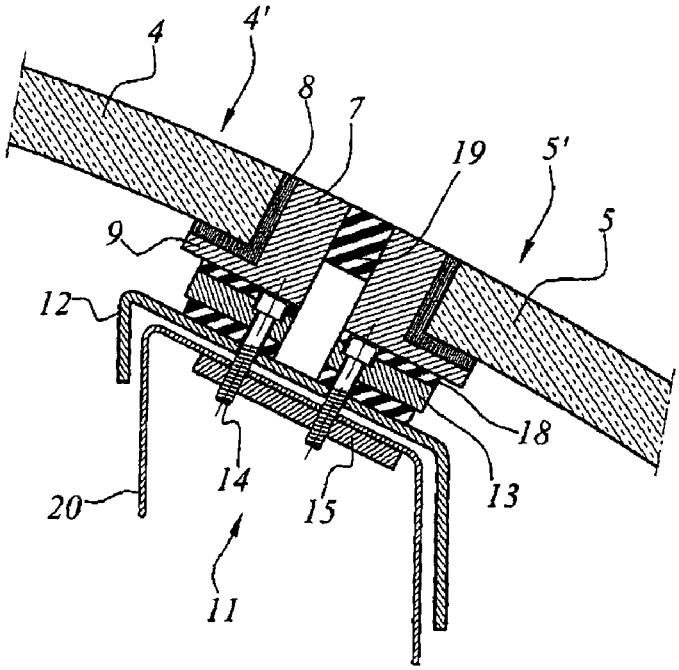
FIG. 3 is a partial cross-section of the canopy along the axis III-III in FIG. 1, the canopy being mounted on the framework.

The periphery of each pane of glass 4, 5, 6 is fitted with a frame 7 to which the pane of glass is, for example, stuck by means of a layer of mastic 8. The assembly formed by a pane of glass 4, 5, 6 and a frame 7 is called window 4', 5', 6' respectively. The frame 7 is made of a metal, for example aluminium. Each L-shaped frame 7 extends along the edges of each pane of glass 4, 5, 6 and supports said pane of glass 4, 5, 6. Each frame 7 comprises an arm 9 extending under said edges on the surface of the pane of glass which is intended to be located on the inner part of the cab 1, as shown in FIGS. 2 to 4.

The canopy 2 comprises a canopy frame 10 to which the windows 4', 5', 6' are attached by means of the respective frame 7 thereof. The canopy frame 10 comprises side rails 11 delimiting openings filled by a window 4', 5', 6' respectively. The canopy frame 10 is formed of a skin 12 made of a composite material and reinforced by a reinforcing framework 20 made of metal. The composite material comprises polyester, for example. The skin 12 allows the canopy 2 to be sealed and provides said canopy with a resistance to pressure waves which occur particularly when the train runs at high-speed through a tunnel.

A sole piece 13 is attached to the upper face, which is intended to be located on the outside of the cab, of the side rails 11 of the support frame 10 using mechanical attaching means 14 such as screws. The sole piece 13 is made of a metal such as aluminium. The sole piece 13 is held on the side rail 11 by tightening the screw 14 into a base plate 15 disposed under a side rail 11.

Figure 4:
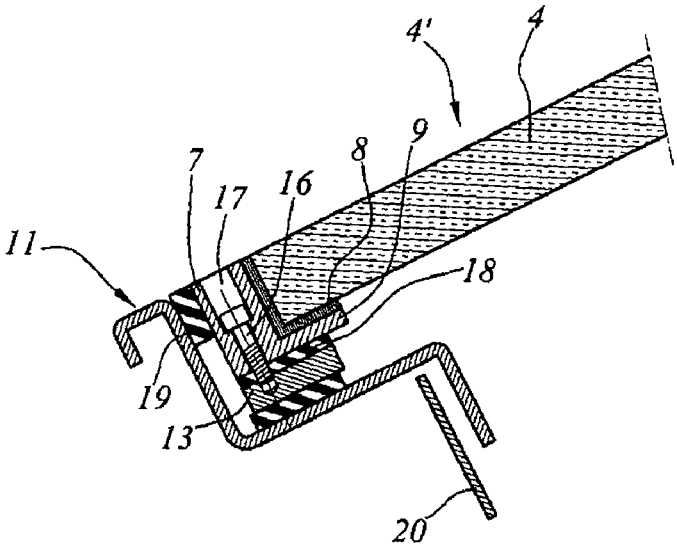
FIG. 4 is a partial cross-section of the zone IV in FIG. 1, the canopy being mounted on the framework.

The frame 7 for the windows 4', 5', 6' is thus attached to the sole piece 13 by mechanical attaching means 16 such as screws, as shown in FIG. 4. The screw 16 passes through the frame 7 and is screwed into the sole piece 13. A stopper 17 is, for example, provided to plug the hole in the frame 7 through which the screw passes, in order that the canopy has a smooth upper surface to improve the aerodynamics of the assembly.

The windows 4', 5', 6' are therefore mechanically attached to the canopy frame 10, and this provides a mechanical resistance to the aerodynamic effects and allows quick disassembly which cannot be achieved if the panes of glass are attached directly onto the side rails 11 using glue.

Furthermore, this method of attaching the windows 4', 5', 6' to the canopy frame 10 by means of a sole piece 13 allows the frame 10 to be permanently attached to the framework 3, only one window 4', 5', or 6' needing to be changed if said window breaks by removing the frame 7 from the sole piece 13.

Sealing means 18, 19, 21 are provided between the periphery of each pane of glass 4, 5, 6 and the support frame 10.

At the joint between the windshield 4 and the front apertures 5, the periphery of these panes of glass is connected to the support frame 10 as previously mentioned and the frames 7 of these panes of glass are spaced apart one from the other by sealing means 19, as shown in FIG. 3.

The canopy 2 thus produced forms a dome-shaped assembly which is attached in one piece to the framework 3, as shown in FIG. 1. The shape of the domed canopy is aerodynamically suited to a train driver's cab 1. Therefore, when the canopy 2 is attached to the framework 3, the skin 12 is flush with the skin of the cab 1 to ensure optimum aerodynamics of the assembly.

The invention claimed is:

1. A method for assembling a driver's cab of a train comprising the steps of:

assembling a framework defining an internal volume, the framework having an upper opening for receiving panes of glass of the cab;

assembling a canopy in a single piece, the canopy including a canopy frame provided with side rails defining at least two openings therebetween and at least one pane of glass filling each opening respectively;

attaching the canopy in a single piece to the framework to cover the upper opening of the framework and to enclose the internal volume; and mounting equipment in the driver's cab by passing the equipment through the upper opening of the framework prior to the step of attaching the canopy to the framework.

2. The method for assembling a driver's cab as recited in claim 1 wherein the at least one pane of glass fill the openings in the canopy prior to the canopy being attached to the framework.

3. The method for assembling a driver's cab according to claim 1 wherein the at least one pane of glass are fixed panes of glass.

4. The method for assembling a driver's cab of a train as recited in claim 1 wherein the canopy includes all the fixed panes of glass of the driver's cab.

5. The method of assembling a driver's cab as recited in claim 1 wherein the canopy includes all the panes of glass of the cab.

6. The method of assembling a driver's cab as recited in claim 1 wherein the canopy frame includes a skin made of an impermeable composite material.

7. The method of assembling a driver's cab as recited in claim 1 wherein the step of assembling the canopy includes attaching a periphery of each pane of glass to the side rails via a mechanical attachment.

8. The method of assembling a driver's cab as recited in claim 1 wherein the step of assembling the canopy includes surrounding each pane of glass by a metal frame forming a periphery of the respective pane of glass and attaching the frame to the side rails via a mechanical attachment.

9. The method of assembling a driver's cab as recited in claim 1 wherein the step of assembling the canopy includes attaching a metal sole piece to the side rails of the canopy frame and attaching a periphery of each pane of glass to the sole piece via a mechanical attachment.

10. The method of assembling a driver's cab as recited in claim 1 wherein the canopy frame includes a skin made of a composite material including polyester.

11. The method of assembling a driver's cab as recited in claim 1 wherein the canopy is in the form of a dome.

12. The method of assembling a driver's cab as recited in claim 1 wherein the step of assembling the driver's cab includes disposing a seal between a periphery of each pane of glass and the canopy frame.

* * * * *